United States Patent [19]

Oldenburg et al.

[11] Patent Number: 4,929,379

[45] Date of Patent: May 29, 1990

[54] PARTICULATE DETERGENT COMPOSITION

[75] Inventors: Willem Oldenburg, Vlaardingen; Simon N. Hemmes, Bilthoven; Jaap E. Hobbel, De Meern, all of Netherlands

[73] Assignee: Lever Brothers Company, New York, N.Y.

[21] Appl. No.: 206,906

[22] Filed: Jun. 10, 1988

Related U.S. Application Data

[63] Continuation of Ser. No. 727,201, Apr. 29, 1985, abandoned, which is a continuation of Ser. No. 572,045, Jan. 19, 1984, abandoned.

[30] Foreign Application Priority Data

Jan. 20, 1983 [GB] United Kingdom ..... 8301503
May 27, 1983 [GB] United Kingdom ..... 8314839

[51] Int. Cl.[5] ..... C11D 9/14; C11D 17/08

[52] U.S. Cl. ..... 252/109; 252/97; 252/110; 252/DIG. 14; 252/108

[58] Field of Search ..... 252/108, 109, 174.14, 252/174.21, 135

[56] References Cited

U.S. PATENT DOCUMENTS

| | | | |
|---|---|---|---|
| 3,654,168 | 4/1972 | Gaiser | 252/135 |
| 3,814,692 | 9/1975 | Mostow | 252/108 |
| 3,862,049 | 1/1975 | McGrath et al. | 252/108 |
| 3,907,702 | 6/1976 | Mostow | 252/370 |
| 4,082,684 | 4/1978 | Kreischer | 252/109 |
| 4,115,308 | 9/1978 | Guerry | 252/135 |
| 4,261,850 | 4/1981 | Manders et al. | 252/108 |
| 4,265,777 | 5/1981 | Boyer et al. | 252/179 |
| 4,310,432 | 1/1982 | Brouwer | 252/108 |
| 4,382,825 | 5/1983 | McCready | 134/2 |

FOREIGN PATENT DOCUMENTS

| | | |
|---|---|---|
| 542414 | 6/1957 | Canada . |
| 2132035 | 11/1973 | Fed. Rep. of Germany . |
| 2447945 | 4/1975 | Fed. Rep. of Germany . |
| 2645881 | 4/1977 | Fed. Rep. of Germany . |
| 521566 | 5/1940 | United Kingdom . |
| 1232009 | 5/1971 | United Kingdom . |
| 1560073 | 11/1975 | United Kingdom . |
| 1415719 | 1/1980 | United Kingdom . |
| 2034741 | 6/1980 | United Kingdom . |
| 1595293 | 8/1981 | United Kingdom . |

OTHER PUBLICATIONS

McCutcheon's, "Emulsifiers & Detergents", North American Ed., MC Publishing Co., N.J.-p. 267.

*Primary Examiner*—Prince E. Willis
*Attorney, Agent, or Firm*—Ronald A. Koatz

[57] ABSTRACT

The invention pertains to a particulate detergent composition comprising a detergent active system consisting of a fatty acid soap component having a Krafft temperature of below 30° C. and an alkoxylated alcohol nonionic component having an HLB value of between 12 and 16, an alkaline buffering agent and a builder. The composition provides a particulate product, which is easily water-dissolvable without any significant agitation to form stable concentrated alkaline stock-solutions.

14 Claims, No Drawings

PARTICULATE DETERGENT COMPOSITION

This is a continuation of Ser. No. 727,201, filed April 29, 1985 now abandoned, which in turn is a continuation of Ser. No. 572,045 filed Jan. 19, 1984 now abandoned.

The invention relates to particulate laundry detergent compositions. More particularly it relates to laundry detergent compositions on the basis of a highly alkaline nonionic/soap active system which can be suitably used for preparing stock solutions for laundering.

In the area of industrial laundering, stock-solution products, i.e. products which are suitable for preparing aqueous concentrated detergent solutions, generally of about 5 to 15% solution of a detergent composition, are well known and are gaining importance due to the increasing penetration of continuous washing machines. In view of the steadily increasing world-market prices of synthetic raw materials as opposed to the decreasing prices of renewable materials, it has become advantageous to include larger proportions of natural soaps replacing at least partly the commonly used synthetic detergent materials.

In the particular field of industrial laundering, detergent compositions including substantial amounts of soap have the further advantage of facilitating the handling of the laundry in the finishing department, owing to the lubricating effect of precipitated soap on wash goods, in e.g. calenders.

Compositions including a substantial proportion of natural soaps in combination with nonionic detergent materials are known in the art.

In GB 1 560 073 a moderately alkaline heavy duty fabric washing powder is described comprising an alkoxylated alcohol nonionic surfactant, a water-soluble soap and a phosphate builder. The nonionic surfactant preferably has an HLB in the range of 9 to 13 and the soap component preferably is a mixture of soaps derived from tallow fats and soaps derived from nut oils. It is preferred that the soap mixture should be predominantly saturated, which results from using hardened fatty acids.

In U.S. Pat. No. 3 814 692 a free-flowing low-sudsing soap/non-ionic detergent is described in which the soap component is derived from hardened $C_8$–$C_{22}$ fatty acids and the nonionic surfactant is a reaction product of ethylene oxide with a hydrophobic compound containing a carboxyl, mercapto, amido, amino, or hydroxy group.

GB 1 415 719 relates to a liquid stock-solution product comprising a liquid nonionic surfactant, a $C_8$–$C_{22}$ fatty acid having a melting/pour point of up to 25° C. and water. The slightly acid product requires separate addition of alkaline builders in the main wash cycle.

It is clear that in the prior art the usefulness of soap/-nonionic-based detergents has been recognised, but hitherto it still has not been possible to formulate a composition which has the important advantage of being a dry particulate product which is also completely consumer-satisfactory in that it is easily dissolving to form a detergent stock-solution which is stable, non-gelling and provides good detergency.

It has now been found that by combining specific types of soap and nonionic detergent (to be defined hereinafter) an improved laundry detergent in particulate form can be formulated, which is easily dissolvable in water at temperatures between 20° C. and 60° C. without requiring any significant agitation.

With the particulate product according to the invention concentrated highly alkaline stock-solutions can be prepared, which are stable under a wide range of temperatures, which are non-gelling at low temperatures, and show excellent detergency.

In its broadest aspects the present invention provides a particulate detergent composition comprising:

(a) from 5 to 40% by weight of a detergent-active system which consists essentially of
  (1) up to 75% by weight of a water-soluble fatty acid soap component having a Krafft-temperature of below 30° C., and
  (2) an alkoxylated alcohol nonionic component having an HLB value between 12 and 16;
(b) from 20 to 70% by weight of an alkaline buffering agent; and
(c) up to 40% by weight of a builder, the balance being conventional minor ingredients and water.

According to the present invention suitable fatty acid soaps may be in the form of sodium, potassium, ammonium or ethanolamine salts, the sodium salts being preferred. An essential criterion in selecting the fatty acid soap component is its Krafft-temperature, which for the purposes of this invention may conveniently be defined as the minimum temperature at which a 20% soap concentration is readily soluble in water forming a micellar solution. According to the invention suitable soaps have a Krafft-temperature of below 30° C., preferably of below 25° C. or even 20° C. The lower limit of the Krafft-temperature is for practical reasons about 0° C. Particularly advantageous for use in compositions of the invention is a mixture of fatty acid soaps comprising at least one soap derived from $C_8$–$C_{14}$ saturated fatty acids and at least one soap derived from $C_{16}$–$C_{22}$ mono- and/or di-unsaturated fatty acids, wherein the weight ratio between the $C_8$–$C_{14}$ soap and the $C_{16}$–$C_{22}$ soap is less than or equal to 9 or even 4. It is preferred that no more than 25% by weight of the soap component should be $C_{16}$–$C_{18}$ saturated fatty acid soaps.

Suitable nonionic surfactants are alkoxylated long-chain alcohols. The alcohols from which the nonionic surfactants can be prepared are primary or secondary alcohols containing straight or branched carbon chains, but preferably should not contain aromatic rings. Primary straight chain alcohols are preferred. The number of carbon atoms will generally be from 7 to 24, preferably from 8 to 18 and most preferably from 12 to 16. The alcohols are condensed with at least 6 alkylene oxide units, which may be ethylene oxide, propylene oxide, butylene oxide or mixtures thereof. Generally the number of alkylene oxide units per alcohol molecule should not exceed 15 and preferably does not exceed 12.

The relationship between the chain length of the hydrophobic part of the molecule and that of the hydrophylic part can be expressed numerically as the hydrophylic-lipophylic balance (HLB). For the present invention a suitable definition of the HLB-value is given by the expression:

$$HLB = 1/5 \times \text{weight percentage of alkylene oxide.}$$

Nonionic surfactants which are suitable for use in the present compositions generally have HLB values ranging from 12 to 16, in particular from 12 to 15. An important factor to be considered in the selection of the nonionic, is its effect on the foaming behaviour of the composition.

If a rich-foaming composition is aimed at, it is advantageous to select alkoxylated alcohols having polyalkoxy groups which are exclusively or almost exclusively derived from ethyleneoxide, and preferably having HLB values ranging from 12 to 13.5 or even from 12.2 to 12.7. If on the other hand a low foaming-profile is desired, it is more advantageous to select alkoxylated alcohols having polyalkoxy groups which are not exclusively derived from ethyleneoxide, but which also include proportions of propyleneoxide and/or butyleneoxide, HLB values preferably ranging from 13 to 15 or even from 14 to 15. As too high a proportion of propylene- or butyleneoxide unfavourably influences biodegradability of the alkoxylated alcohols, it is often necessary to compromise between low foaming behaviour and good biodegradability.

Preferred examples of alkoxylated alcohols are members of the following series: Ethoxylates of primary linear alcohols sold by Shell Chemicals Ltd. (Dobanols Trade Mark) and Shell Chemicals Co. (Neodols Trade Mark), especially Dobanol and Neodol 25-7, 25-9, 25-12, 45-7, 45-11, 45-13, 91-6, 91-8, which are ethoxylates of mixtures of $C_{12}$–$C_{15}$, $C_{14}$–$C_{15}$ and $C_9$–$C_{11}$ alcohols, respectively, the degree of ethoxylation being indicated by the post-scripts; Synperonics (Trade Mark), a series of ethoxylates or mixed alkoxylates of alcohols containing 45 to 55% of alkyl branching, sold by Imperial Chemical Industries Ltd.; Alfols (Trade Mark) ex Conoco-Condea, especially Alfol 12/14-7, 12/14-9, 12/14-12, 14/12-7, 14/12-9 and 14/12-12, which are ethoxylates of mixtures of $C_{12}$–$C_{14}$ alcohols; Lutensols (Trade Mark) ex Badische Anilin und Soda Fabrik GmbH, especially Lutensol AO 8 and AO12, which are ethoxylates of synthetic $C_{13}$–$C_{15}$ straight chain alcohols; Genapols ex Hoechst AG, especially Genapol AO 12, which is an ethoxylate of a $C_{12}$–$C_{15}$ alcohol; Plurafacs (Trade Mark) ex Ugine Kuhlmann, especially Plurafac RA 30 and RA 40, which are $C_{12}$–$C_{15}$ alcohols being condensed with mixtures of ethylene- and propylene-oxide; Marlox (Trade Mark) ex Chemische Werke Hüls AG, especially Marlox FK 14 and FK 64, which are $C_{13}$–$C_{14}$ alkoxylated alcohols.

The required HLB can be achieved not only by selection of a single or substantially single alkoxylated alcohol, but also by deliberately taking two nonionic materials having different HLBs and mixing them.

The total amount of surface-active material in general ranges from 5 to 40%, in particular from 5 to 30%, and preferably from 5 to 15% by weight of the total composition. It is preferred that the soap and nonionic surfactant should be the only surface-active agents, but small amounts of other surface active ingredients can be tolerated. To ensure the good product characteristics of the compositions of the invention the amount of the soap component should not exceed 75% by weight of the total surfactant mixture. Preferably more than 30% by weight of the soap component is included, the most preferred range being from 40 to 55% by weight of the surfactant mixture. Accordingly, when the soap and nonionic are the sole surface-active agents, the weight ratio between the soap and nonionic component does not exceed 3 and preferably lies between 0.5 and 2 or even between 0.75 and 1.3.

It will be appreciated that if the total amount of surfactant is taken near the maximum of about 40%, such as above 30% by weight, the relative amount of the soap component should be taken somewhat less than maximum, such as e.g. less than about 50% by weight of the total surfactant mixture.

To provide high alkalinity, compositions of the invention contain an alkaline buffering agent, which may be any such agent capable of providing a 1% product solution with a pH of above 11.5 or even 12. Advantageous alkaline buffering agents are the alkalimetal silicates, as they decrease the corrosion of metal parts in washing machines, and in particular sodium ortho-, meta- or di-silicates, of which sodium metasilicate is preferred. The alkaline buffering agent is present in an amount of from 20 to 70% by weight, preferably from 30 to 50% by weight.

In addition the compositions of the invention can and normally will contain detergency builders in an amount of up to 40% by weight and preferably from 5 to 25% by weight of the total composition.

Suitable builders include sodium, potassium and ammonium or substituted ammonium pyro- and tri-polyphosphates, -ethylene diamine tetraacetates, -nitrilotriacetates, -etherpolycarboxylates, -citrates, -carbonates, -orthophosphates, -carboxymethyloxysuccinates, etc. Also less soluble builders may be included, such as e.g. an easily dispersible zeolite. Particularly preferred are the polyphosphate builder salts, nitrilotriacetates, citrates, carboxymethyloxysuccinates and mixtures thereof.

Other conventional materials may be present in minor amounts, provided they exhibit a good dissolving or dispersing behaviour; for example sequestering agents, such as ethylenediamine tetraphosphonic acid; soil-suspending agents, such as sodiumcarboxymethylcellulose, polyvinylpyrrolidone or the maleic anhydride/ vinylmethylether copolymer; hydrotropes; dyes; perfumes; optical brighteners; alkali-stable enzymes; germicides; anti-tarnishing agents; lather depressants; fabric softening agents; oxygen- or chlorine-liberating bleaches, such as dichlorocyanuric acid salts or alkalimetal hypochlorites.

The remainder of the composition is water, which is preferably present in hydrated form, such as e.g. in the form of silicate.5aq.

The invention is further illustrated by the following Examples, in which parts and percentages are by weight, unless indicated otherwise.

EXAMPLES 1–10

A particulate detergent composition was prepared having the following formulation:

| Ingredient | % |
|---|---|
| Sodium soap | 5 |
| Krafft temperature: 10° C. | |
| Fatty acid composition: sat. $C_8$–$C_{14}$ 50% | |
| sat. $C_{16}$–$C_{22}$ 10% | |
| mono- and di-unsat. $C_{16}$–$C_{22}$ 40% | |
| Primary linear ethoxylated alcohol | 5 |
| Sodium metasilicate | 48 |
| Sodium tripolyphosphate | 18 |
| Water, minors | balance |

From the above composition aqueous, stock-solutions at 10% product concentration were prepared using different ethoxylated alcohols. For reasons of comparison also examples are presented where nonyl phenol derived nonionics are used. The stability behaviour of each stock-solution was assessed in the temperature range of from 5° C. to 37° C. Results are given in Tables A and B, which clearly show the stability-dependence on the choice of ethoxylated alcohol.

TABLE A

| Example | Ethoxylated alcohol C-chain | EO-chain | HLB | Stability* |
|---|---|---|---|---|
| 1 | 9–11 | 5 | 11.6 | – |
| 2 | 13–14 | 6 | 11.8 | – |
| 3 | 12–15 | 7 | 12.0 | + |
| 4 | 9–11 | 6 | 12.5 | + |
| 5 | 12–15 | 9 | 13.2 | + |
| 6 | 9 + phen. | 10 | 13.6 | – |
| 7 | 12–15 | 12 | 14.4 | + |
| 8 | 13–15 | 12 | 14.7 | + |
| 9 | 9 + phen. | 14 | 15.3 | – |
| 10 | 9 + phen. | 20 | 16.2 | – |

*+ = acceptable; – = unacceptable

In Table B the type of (in)stability is specified in more detail.

TABLE B

| Example | Gelation | Phase separation | Discoloration | Turbidity |
|---|---|---|---|---|
| 1 | no | yes | no | no |
| 2 | no | yes | no | no |
| 3 | slight | no | no | no |
| 4 | no | no | some | no |
| 5 | slight | slight | no | no |
| 6 | some | no | no | yes |
| 7 | no | no | some | no |
| 8 | no | no | some | no |
| 9 | some | some | some | yes |
| 10 | some | some | some | yes |

All products showed some white deposits.

EXAMPLES 11–19

A particulate detergent composition was prepared having the following formulation:

| Ingredient: | % |
|---|---|
| Sodium soap | 12.5 |
| Krafft-temperature: variable | |
| Fatty acid composition: sat. $C_8$–$C_{14}$ 10% | |
| sat. $C_{16}$–$C_{22}$ 0–40% | |
| mono- and di-unsat. $C_{16}$–$C_{22}$ 50–90% | |
| Linear alkyl sulphonate | 2.0 |
| Primary linear ethoxylated alcohol | 4.0 |
| alcohol chain length: $C_{13}$–$C_{15}$ | |
| av. number of EO units: 9 | |
| HLB value: 13.0 | |
| Sodium metasilicate | 48.0 |
| Sodium tripolyphosphate | 18.0 |

From the above composition aqueous, stock solutions at 10% product concentration were prepared using soap-mixtures having different Krafft-temperatures.

The stability behaviour of each solution was assessed at 20° C. Results are presented in Table C, which clearly shows the dependence of the stability on the Krafft-temperature of the soap-mixture.

TABLE C

| Example | Krafft-temp. °C. | Stability* | Gelation | Phase separation | Turbidity |
|---|---|---|---|---|---|
| 11 | 0 | + | no | no | no |
| 12 | 5 | + | no | no | no |
| 13 | 10 | + | no | no | no |
| 14 | 15 | + | no | no | no |
| 15 | 20 | + | no | no | some |
| 16 | 25 | +/– | some | some | some |
| 17 | 30 | – | yes | yes | yes |
| 18 | 35 | – | yes | yes | yes |

TABLE C-continued

| Example | Krafft-temp. °C. | Stability* | Gelation | Phase separation | Turbidity |
|---|---|---|---|---|---|
| 19 | 40 | – | yes | yes | yes |

*+ denotes acceptable; – denotes unacceptable

EXAMPLES 20–23

A particulate detergent composition was prepared having an increased detergent-active content.

| Ingredients: | |
|---|---|
| Detergent-active material | 34% |
| sodium soap 12–18% | |
| soap composition: sat. $C_8$–$C_{14}$ 40% | |
| sat. $C_{16}$–$C_{22}$ 18% | |
| mono- and di-unsat. $C_{16}$–$C_{22}$ 42% | |
| Krafft-temperature: 15° C. | |
| prim. lin. ethoxylated alcohol 22–16% | |
| alcohol chain length: $C_{13}$–$C_{15}$ | |
| number of EO units: 7 | |
| HLB value: 12.2. | |
| Sodium metasilicate | 20% |
| Water, minors, salts | balance |

From the above composition aqueous stock solutions at 10% product concentration were prepared using varying weight ratios between the soap and ethoxylated alcohol components as listed in Table D. Stability which was assessed at 10° C., proved to be good. The stock solution prepared with the composition of example 23 showed some slight turbidity.

TABLE D

| Example | Active-composition in particulate product: Soap | Ethoxylated alcohol |
|---|---|---|
| 20 | 12 | 22 |
| 21 | 14 | 20 |
| 22 | 16 | 18 |
| 23 | 18 | 16 |

EXAMPLE 24

A particulate detergent composition was prepared having the following formulation:

| Ingredient | % |
|---|---|
| alkoxylated alcohol | 5 |
| alcohol chain length: $C_{12}$–$C_{15}$ | |
| av. number of EO units: 4 | |
| av. number of PO units: 6 | |
| HLB value: 14.8 | |
| sodium soap | 5 |
| Krafft temperature: 10° C. | |
| sat. $C_8$–$C_{14}$: 35% | |
| sat. $C_{16}$–$C_{22}$: 15% | |
| unsat. $C_{16}$–$C_{22}$: 50% | |
| sodium metasilicate. 5 $H_2O$ | 70 |
| alk. sodium silicate | 10 |
| sodium tripolyphosphate | 8 |
| minor ingredients | 2 |

An aqueous, stock solution was prepared at 10% product concentration. Stability of the stock solution which was assessed at 5° C., 20° C. and 37° C. was found to be excellent.

We claim:

1. A particulate detergent composition with improved stock solution behaviour comprising:
(a) from 5 to 40% by weight of a detergent active system which consists essentially of
1. up to 75% by weight of a water-soluble fatty acid soap component having a Krafft-temperature of below 30° C., said component constituting at least 5% of the detergent composition; and
2. an alkoxylated alcohol nonionic component having an HLB-value of between 12 and 16;
(b) from 20 to 70% by weight of an alkaline buffering agent such that a 1% solution of said composition has a pH of above 11.5; and
(c) up to 40% by weight of a detergency builder selected from the group consisting of sodium, potassium, ammonium, and substituted ammonium pyrophosphates, -tripolyphosphates, -ethylene diamine tetracetates, -nitrilotriacetates, -ether-polycarboxylates, -citrates, -carbonates, -orthophosphates, -carboxymethyloxysuccinates, and mixtures thereof; and water;
wherein an aqueous stock solution at 10% concentration of said detergent composition exhibits substantially no gelation, phase separation or turbidity at 20° C.

2. A composition according to claim 1 wherein the composition comprises:
(a) from 5–15% by weight of said detergent active system;
(b) from 30–50% by weight of an alkaline buffering agent selected from the group consisting of alkali metal ortho-, meta-and disilicates; and
(c) from 5–25% by weight of a phosphate builder.

3. A composition according to claim 1 wherein said detergent active system comprises from 40–55% by weight of said soap component.

4. A composition according to claim 1 wherein said nonionic component has a HLB-value of between 12 and 13.5, wherein said composition exhibits rich-foaming properties.

5. A composition according to claim 1 wherein said nonionic component has a HLB-value of between 14 and 15, wherein said composition exhibits low-foaming properties.

6. A composition according to claim 1, further comprising an effective amount of conventional minor ingredients selected from the group consisting of sequestering agents, soil-suspending agents, hydrotropes, dyes, perfumes, optical brighteners, alkali-stable enzymes, germicides, anti-tarnishing agents, lather depressants, fabric softening agents, and oxygen- or chlorine-liberating bleaches.

7. A composition according to claim 1 wherein said water-soluble fatty acid soap component has a Krafft-temperature of below 20° C.

8. An aqueous detergent preparation comprising a solution of 5% to 15% of a particulate detergent composition in water wherein said detergent composition comprises:
(a) from 5 to 40% by weight of a detergent active system which consists essentially of
1. up to 75% by weight of a water-soluble fatty acid soap component having a Krafft-temperature of below 30° C., said soap component constituting at least 5% of the detergent composition; and
2. an alkoxylated alcohol nonionic component having an HLB-value of between 12 and 16;
(b) from 20 to 70% by weight of an alkaline buffering agent such that a 1% solution of said composition has a pH of above 11.5; and
(c) up to 40% by weight of a detergency builder selected from the group consisting of sodium, potassium, ammonium and substituted ammonium pyrophosphates, -tri-polyphosphates, -ethylene diamine tetracetates, -nitrilotriacetates, -ether-polycarboxylates, -citrates, -carbonates, -orthophosphates, -carboxymethyloxysuccinates, and mixtures thereof; the balance being minor ingredients and water;
wherein said aqueous detergent preparation exhibits substantially no gelation, phase separation or turbidity at a 10% concentration of said detergent composition at 20° C.

9. An aqueous detergent preparation according to claim 8 wherein said detergent composition comprises
(a) from 5 to 15% by weight of said detergent active system;
(b) from 30 to 50% by weight of an alkaline buffering agent selected from the group consisting of alkali metal ortho-, meta- and disilicates; and
(c) from 5 to 25% by weight of a phosphate builder.

10. An aqueous detergent preparation according to claim 8 wherein said detergent active system comprises from 40 to 55% by weight of said soap component.

11. An aqueous detergent preparation according to claim 8 wherein said nonionic component of said detergent composition has an HLB-value of between 12 and 13.5, and said composition exhibits rich-foaming properties.

12. An aqueous detergent preparation according to claim 8 wherein said nonionic component of said detergent composition has an HLB-value of between 14 and 15 and said composition exhibits low-foaming properties.

13. An aqueous detergent preparation according to claim 8, further comprising an effective amount of conventional minor ingredients selected from the group consisting of sequestering agents, soil-suspending agents, hydrotropes, dyes, perfumes, optical brighteners, alkali-stable enzymes, germicides, anti-tarnishing agents, lather depressants, fabric softening agents, and oxygen- or chlorine-liberating bleaches.

14. An aqueous detergent preparation according to claim 8 wherein said water-soluble fatty acid soap component of said detergent composition has a Krafft-temperature of below 20° C.

* * * * *